US008100343B2

(12) United States Patent
Michelsen

(10) Patent No.: US 8,100,343 B2
(45) Date of Patent: Jan. 24, 2012

(54) WATER SPRINKLER TOY

(76) Inventor: Jeff A. Michelsen, Glendora, CA (US)

( * ) Notice: Subject to any disclaimer, the term of this patent is extended or adjusted under 35 U.S.C. 154(b) by 146 days.

(21) Appl. No.: 12/428,319

(22) Filed: Apr. 22, 2009

(65) Prior Publication Data

US 2009/0266908 A1 Oct. 29, 2009

Related U.S. Application Data

(60) Provisional application No. 61/125,605, filed on Apr. 28, 2008.

(51) Int. Cl.
*B05B 17/08* (2006.01)

(52) U.S. Cl. ..... 239/17; 239/16; 239/211; 239/222.17; 239/273; 239/275; 239/289; 239/390; 239/451; 446/176; 446/187; 446/211; 473/418

(58) Field of Classification Search ..... 239/16, 239/17, 211, 222.17, 273, 275, 279, 289, 239/390, 391, 453, 456–458, 468, 451; 446/176, 446/186, 187, 211; 473/418
See application file for complete search history.

(56) References Cited

U.S. PATENT DOCUMENTS

| | | | | |
|---|---|---|---|---|
| 2,785,895 | A | 3/1957 | Neveling, Sr. | |
| 3,326,473 | A * | 6/1967 | Wahlin | 239/468 |
| 4,205,785 | A * | 6/1980 | Stanley | 239/17 |
| 4,496,329 | A | 1/1985 | Kubiatowicz | |
| 4,787,875 | A * | 11/1988 | Baron et al. | 239/289 |
| 4,946,164 | A * | 8/1990 | Fuller et al. | 446/186 |
| 5,403,018 | A * | 4/1995 | Sejnowski et al. | 446/176 |
| 6,599,164 | B1 | 7/2003 | Gerwitz et al. | |
| 6,848,629 | B2 * | 2/2005 | Palmer et al. | 239/17 |

* cited by examiner

*Primary Examiner* — Steven J Ganey
(74) *Attorney, Agent, or Firm* — Christie, Parker & Hale, LLP

(57) ABSTRACT

A water sprinkler toy includes a base having a water inlet and a nozzle adapted to spray water in the shape of a funnel. Additionally, the water sprinkler toy includes an object capable of being suspended in the air by the water.

16 Claims, 5 Drawing Sheets

WATER SPRINKLER TOY

CROSS-REFERENCE TO RELATED APPLICATION

This application claims priority to and the benefit of U.S. Provisional Patent Application No. 61/125,605, filed on Apr. 28, 2008, the entire content of each of which is incorporated herein by reference.

FIELD OF THE INVENTION

The present invention relates to a water sprinkler toy which suspends an object in the air on a column of water.

BACKGROUND OF THE INVENTION

Water toys that shoot a ball into the air or suspend a ball in a stream of water are common. The operation of a traditional water toy fountain is described in U.S. Pat. No. 2,785,895. Numerous toys use a single, substantially laminar stream of water to suspend a ball in the air. In such a device, one stream of water exerts an upward force on a ball that is at least equal to the downward force of gravity. Water striking the ball causes a sheet of water to flow around the object, creating another force which keeps the ball constantly spinning on the edge of the stream of water. These various forces combine to keep the ball suspended in the air.

However, such toys have a number of drawbacks. The stream must be substantially laminar. If the stream is not laminar, the ball will not adhere to the stream, but instead will fly off. Additionally, the ball must be rather small, otherwise the upward force of the stream from a garden hose and the centrifugal force from the sheet of water spinning the ball will not be able to counteract gravity. While larger balls could be used, they would require a large, substantially laminar stream, which would require more water and pressure than a traditional garden hose could provide. Thus, traditionally, small balls, about the size of a baseball are used. Being small, the balls can be easily lost, and are more likely to hurt children playing with the toy. Also, the force required from the water stream to counteract gravity and keep the ball suspended is quite great. Accordingly, children can be hurt while playing with such a toy if the forceful stream of water hits them in the face. Lastly, traditional water toys only properly function when the water stream is substantially parallel to the force of gravity, i.e., directly upward. Thus, either a water toy user either must carefully select level ground, or a stake is required so that the water sprayer may be forced to be vertical on ground that is not level.

SUMMARY OF THE INVENTION

An embodiment of the present invention is directed to a water sprinkler toy having a funnel shaped spray pattern, which is able to suspend an object in the air inside the funnel shaped spray pattern.

In some embodiments of the present invention, the water sprinkler toy has a base with a water inlet and a nozzle, wherein a garden hose is connected to the water inlet. Water travels through the base and out the nozzle, which emits a column of water in a funnel shape. A large object, such as a beach ball, is suspended in the air, inside the funnel shaped spray.

In other embodiments of the present invention, the base of the water sprinkler toy is an animal shape, such as a seal, elephant, or a whale. In such embodiments, the animal shape base has a water inlet and a nozzle. A garden hose is connected to the water inlet. Water then travels through the base toward and out of the nozzle. The nozzle sprays water in a funnel shaped spray pattern. A reservoir in the base holds water in order to provide stability to the base. As in previous embodiments, a large object, such as a beach ball, is suspended in the air, inside the water spray.

BRIEF DESCRIPTION OF THE DRAWINGS

The accompanying drawings, together with the specification, illustrate various aspects and embodiments of the invention.

DETAILED DESCRIPTION OF THE INVENTION

The present invention is a water sprinkler toy that utilizes a funnel shaped water spray pattern to suspend an object, such as a ball, in the air. The present invention has numerous advantages over prior water toys. Unlike prior water toys, large objects, such as beach balls, may be suspended in the funnel or cone shaped water spray pattern. Large objects are much more difficult to lose than small baseball sized balls, and also are less likely to injure children playing with the toy. The funnel shaped spray pattern has significantly less force than if one single laminar stream is used. Accordingly, children are not at all likely to be injured by the force of the water spray of the water sprinkler toy. Lastly, the funnel shaped spray pattern need not be directed straight upward. Accordingly, the toy can be placed on uneven ground or can utilize a base or nozzle that does not direct the funnel shaped spray pattern directly upward.

Figure 1:
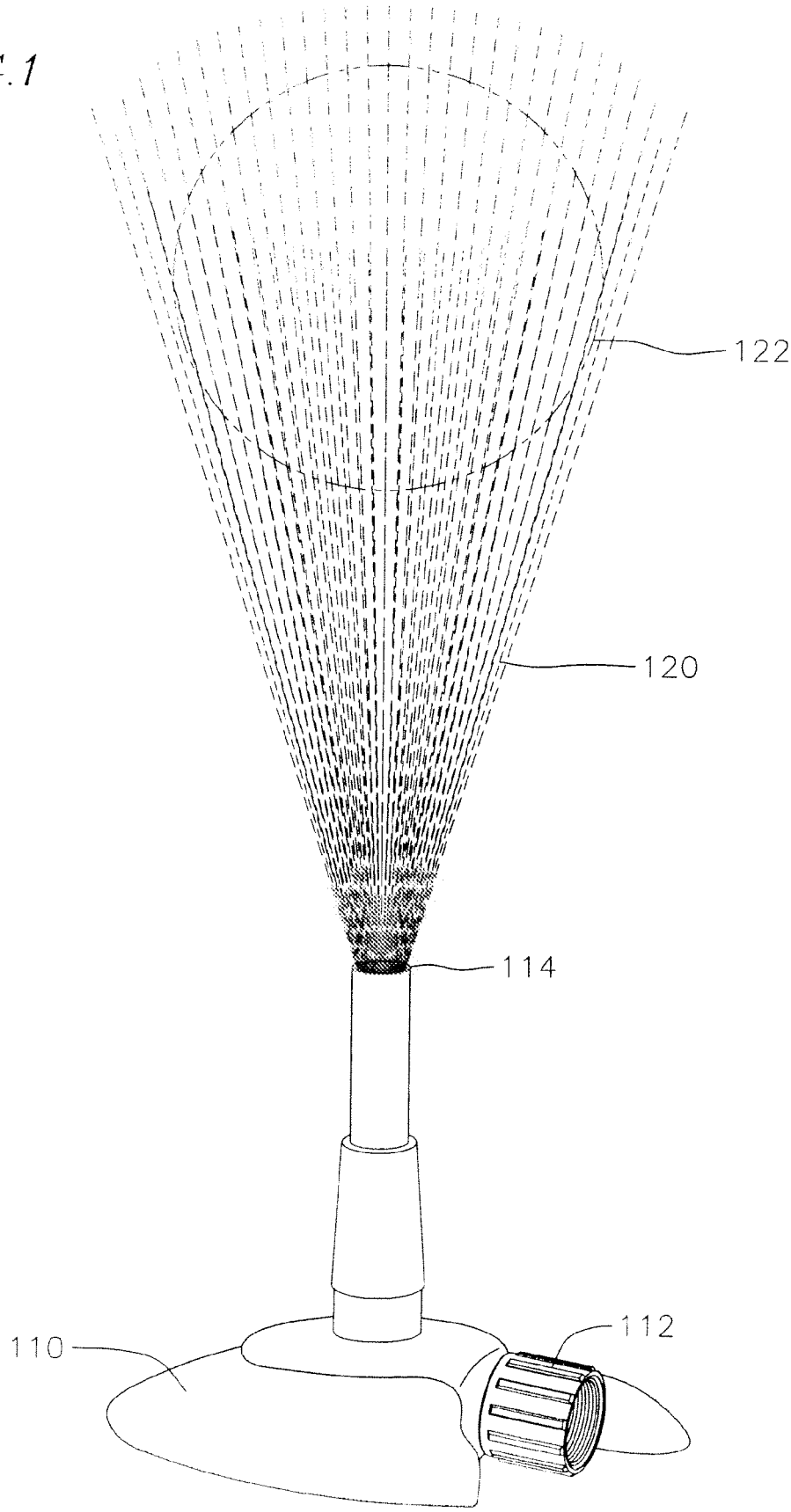
FIG. 1 is a view of a water sprinkler toy according to one embodiment of the present invention.

FIG. 1 depicts a water sprinkler toy according to an embodiment of the present invention. The base 110 may be any type of base. Suitable bases include water sprinkler bases. The base 110 should be relatively stable, so that the base does not tip over. In some embodiments, no weight needs to be added to the base 110 to ensure its stability. Suitable bases include bases traditionally used for yard watering sprinklers. The base 110 includes a water inlet 112. The water inlet 112 may be threaded to receive a traditional garden hose. However, any water source and corresponding inlet may be used. Base 110 also includes a nozzle 114. The nozzle 114 is designed to create a funnel shaped spray pattern 120. Water that is directed into the base 110 through the water inlet 112 is directed out the nozzle 114.

Referring again to FIG. 1, the spray pattern 120 is comprised of water exiting the nozzle 114. The spray pattern 120 could be a funnel shaped spray pattern as depicted in FIG. 1. By referring to the shape of the spray pattern as "funnel shaped," applicant intends such a shape to comprise any hollow spray pattern that tapers outward as it moves away from a nozzle. The funnel shaped spray pattern could be a hollow cone shaped spray pattern 120. A hollow cone shaped spray pattern could be a right circular cone shaped spray pattern, but could also be a right pyramidal cone shaped spray pattern. It is not essential that the spray pattern be a cone shape. Any inverted three-dimensional shaped spray pattern can be used as long as it is hollow, tapers outward as it moves away from the nozzle, and is capable of supporting an object. In other words, the spray pattern may be an outwardly tapering hollow column of water. The column may be any particular shape suitable for supporting an object 122. Unlike prior art, which requires laminar flow, the spray pattern of the present invention does not require laminar flow, and instead may utilize turbulent flow.

Referring again to FIG. 1, an object 122 is suspended in the air by the funnel shaped water spray 120. In FIG. 1, the object 122 is a ball. The object 122 could be inflatable, or it could be a fixed shape. In some embodiments, the object 122 is an inflatable beach ball, allowing for easy storage. However, the object 122 could be any object capable of being suspended by the funnel of water 120 that is suitable for use with a children's toy. In some instances, the object 122 spins inside and around the inverted cone spray pattern 120. In other instances, the object 122 may levitate inside the funnel 120 without spinning.

Figure 2:
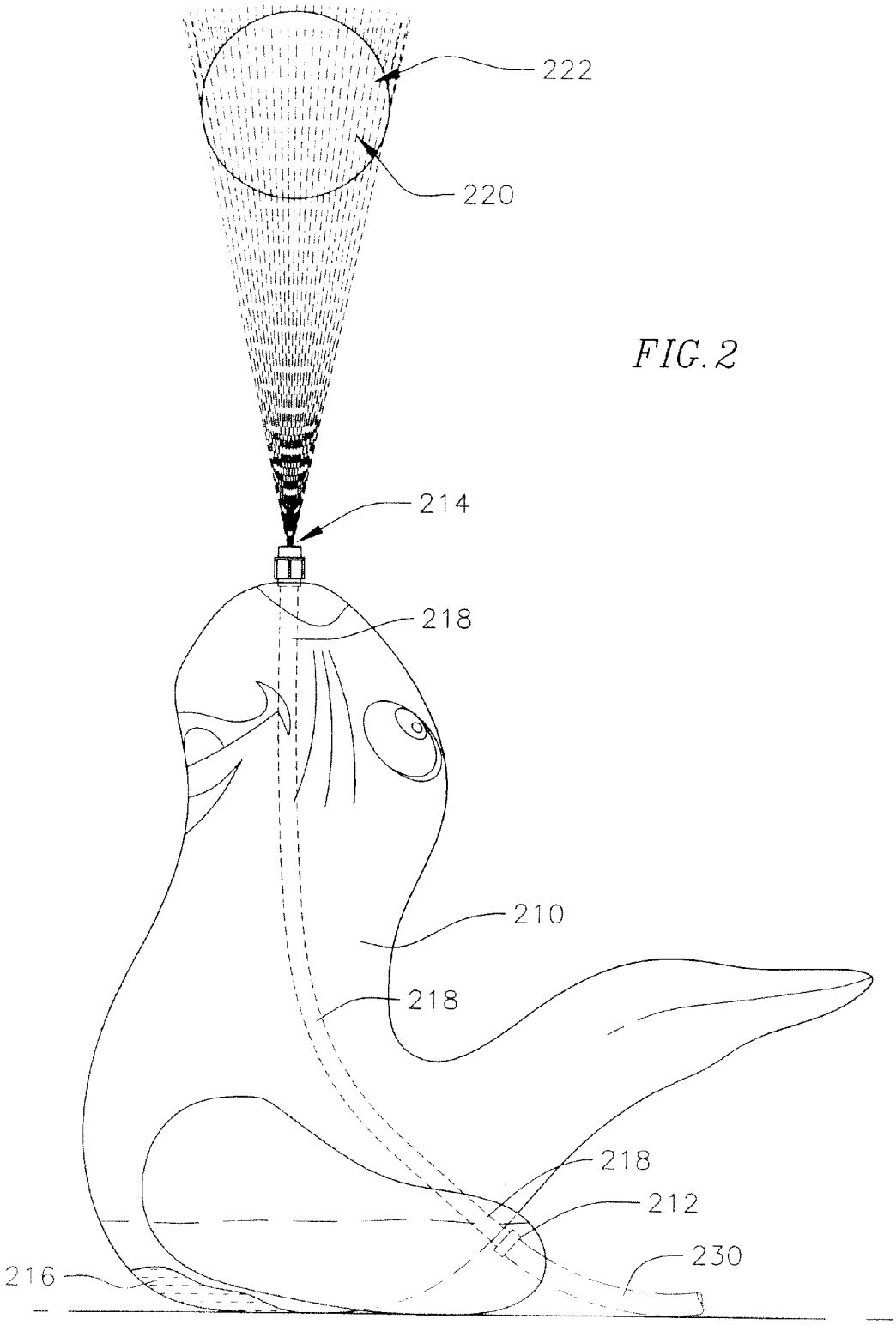
FIG. 2 is a view of a water sprinkler toy according to one embodiment of the present invention, where the base is a toy seal.

FIG. 2 depicts a water sprinkler toy according to another embodiment of the present invention. The base 210 is depicted as a seal. The base 210 could be any number of different animal shapes, such as a whale or an elephant, or other figures. The base 210 could be a fixed shape with its own weight for stability. The base 210 could also be a fixed shape having a reservoir 216 which can be filled with water, sand, or any other material, to add weight and stability to the base. In some embodiments, the base 210 could also be inflatable, which enables easy set up and storage. When using an inflatable base 210, the base 210 may require some weight for stability. FIG. 2 depicts a reservoir 216 in the base 210. The reservoir 216 may be filled with water, sand, or any other material in order to give the base 210 weight, and thus stability. The reservoir should be designed to prevent the water, sand, or other material from unintentionally escaping the base. The base 210 includes a water inlet 212. The water inlet 212 may be threaded to receive a traditional garden hose 230. The water inlet 212 may also be connected to the nozzle 214 through the base 210 via a tube 218, as depicted in FIG. 2. The nozzle 214 is designed to spray water in the shape of a funnel shaped spray pattern 220. Water that is directed into the base 210 through the water inlet 212 is directed out the nozzle 214.

Referring to FIG. 2, an object 222 may be suspended by the funnel shaped spray pattern 220 as in FIG. 1. The object 122 could be any suitable object as described previously.

Figure 3:
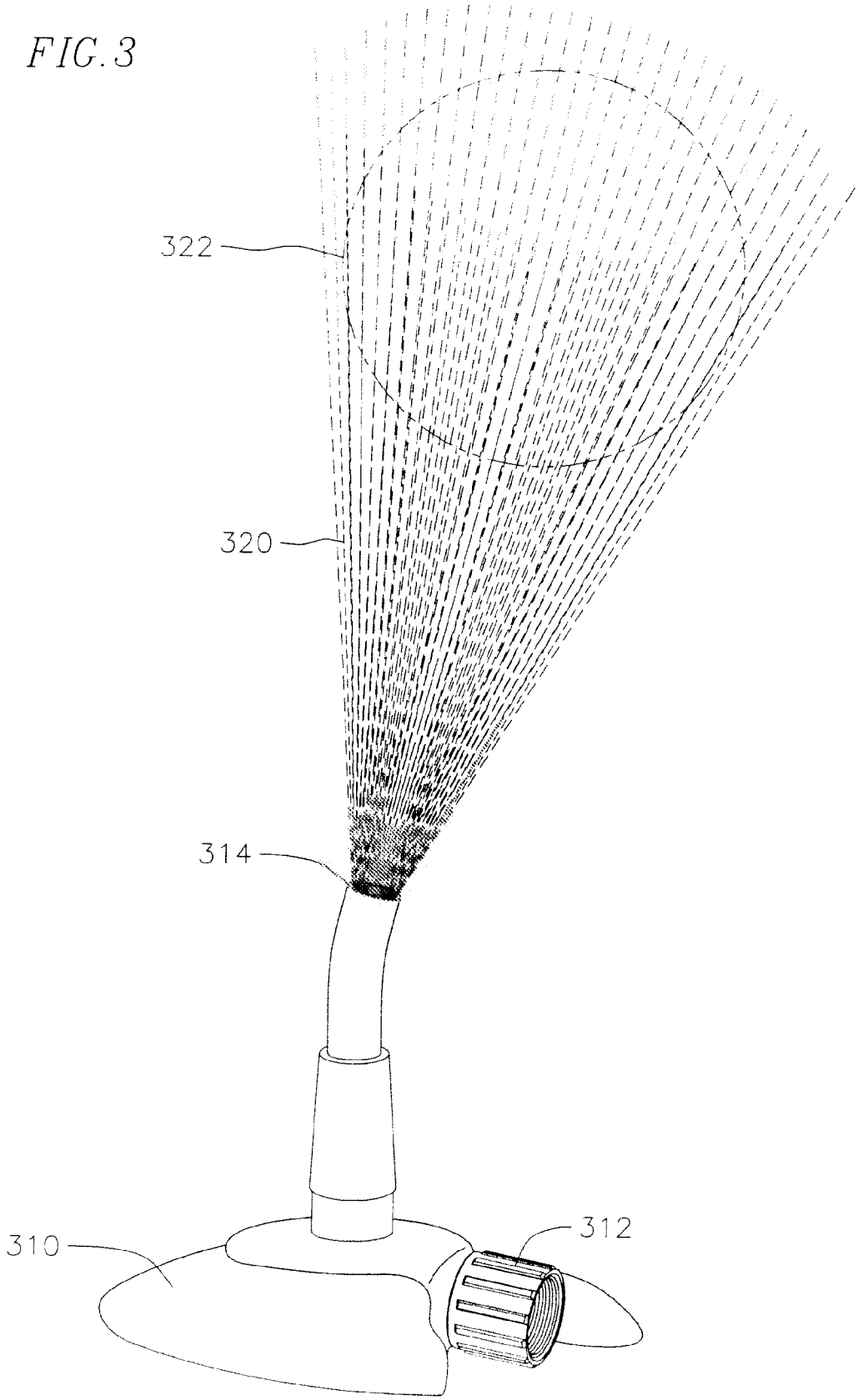
FIG. 3 is a view of a water sprinkler toy according to one embodiment of the present invention, where the nozzle and resulting spray pattern is angled.

FIG. 3 depicts a water sprinkler toy according to another embodiment of the present invention. The base 310 includes a water inlet 312 and a nozzle 314. When water is fed into the inlet 312, through the base, and out the nozzle 314, a spray pattern 320 is created. However, the nozzle 314 of the water sprinkler toy of FIG. 3 is angled away from vertical. Accordingly, the funnel shaped spray pattern exiting the nozzle is similarly angled. This is a unique feature of the present invention, as the water toys of the prior art are not capable of suspending a ball in the air when the stream of water is not substantially vertical.

Figure 4:
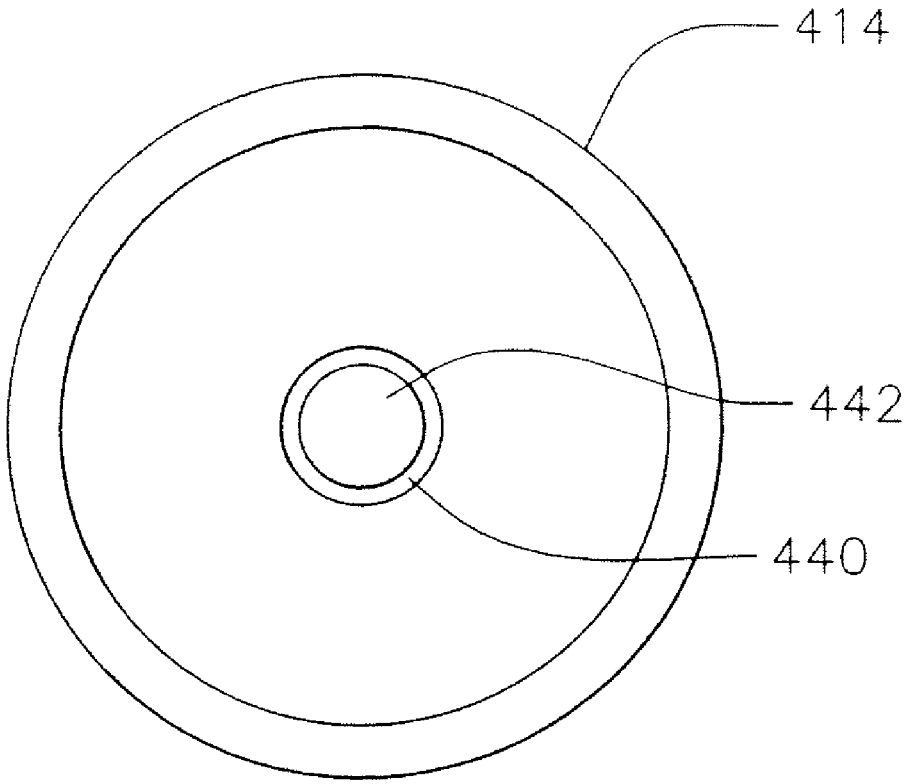
FIG. 4 is a cross-sectional view of a nozzle for a water sprinkler toy according to one embodiment of the present invention.

Referring to FIG. 4, the spray pattern is created by forcing water through the nozzle 414. Water is forced through a hole 440 in the nozzle 414 around a plug 442 in the center of the hole 440, creating a funnel shaped cylindrical pattern around the plug 442. This creates the funnel shaped spray pattern of the present invention. However, various methods of creating a funnel shaped spray pattern may be used. For instance, some showerheads create a funnel shaped spray pattern, thus such a showerhead could be adapted to be used in the present invention.

In some embodiments of the present invention, the nozzle is replaceable. The nozzle may be replaced with nozzles that create varying three-dimensional inverted spray patterns as described above, such as an inverted pyramidal shape. In other embodiments the nozzle could be replaced with nozzles that create funnel shaped spray patterns having various diameters. The base could be threaded to receive replaceable nozzles.

In other embodiments, the nozzle is adjustable so that the cross-sectional area of the spray pattern may be varied. In other words, when the spray pattern is a funnel, the diameter, and thus the cross-sectional area of the funnel, may be varied by adjusting the nozzle. Referring to FIG. 4, a control (not pictured) could be configured to advance and retract the plug 442, which in turn, varies the diameter or cross-sectional area of the funnel shaped spray pattern that is created by the nozzle. Traditional garden hose nozzles often operate by using a nozzle with an adjustable plug which can vary the water flow from a stream to a very wide cone. However, in some embodiments of the present invention, the plug would only be able to advance and retract in a predetermined range. Accordingly, the nozzle could be made to be adjusted within a specified range, such that only various funnel shaped spray patterns may be created.

In some instances, the spray pattern is a fine mist in a funnel shape. When the sun is shining, the sun creates a rainbow in the mist of the spray pattern and in the mist created by the nozzle as the water drifts from the spray pattern. Additionally, as the water drifts in the air, the water mist has a cooling effect as it splashes on those playing with the toy.

In some embodiments, a ball may spin around while being suspended in the air by the water, while in other embodiments, a ball may levitate without spinning. Weight may be added to the ball or other object to encourage it to spin around. For instance, if a fixed shape ball is used, weight may be affixed to the interior of the ball during manufacture to make the ball unequally weighted. The added weight at one portion of the ball should encourage the ball to spin around more while being suspended in the air. Or, if a beach ball is used, the inflation tube mouthpiece traditionally used to inflate the beach ball may be sufficient weight to encourage the beach ball to spin around.

Figure 5:
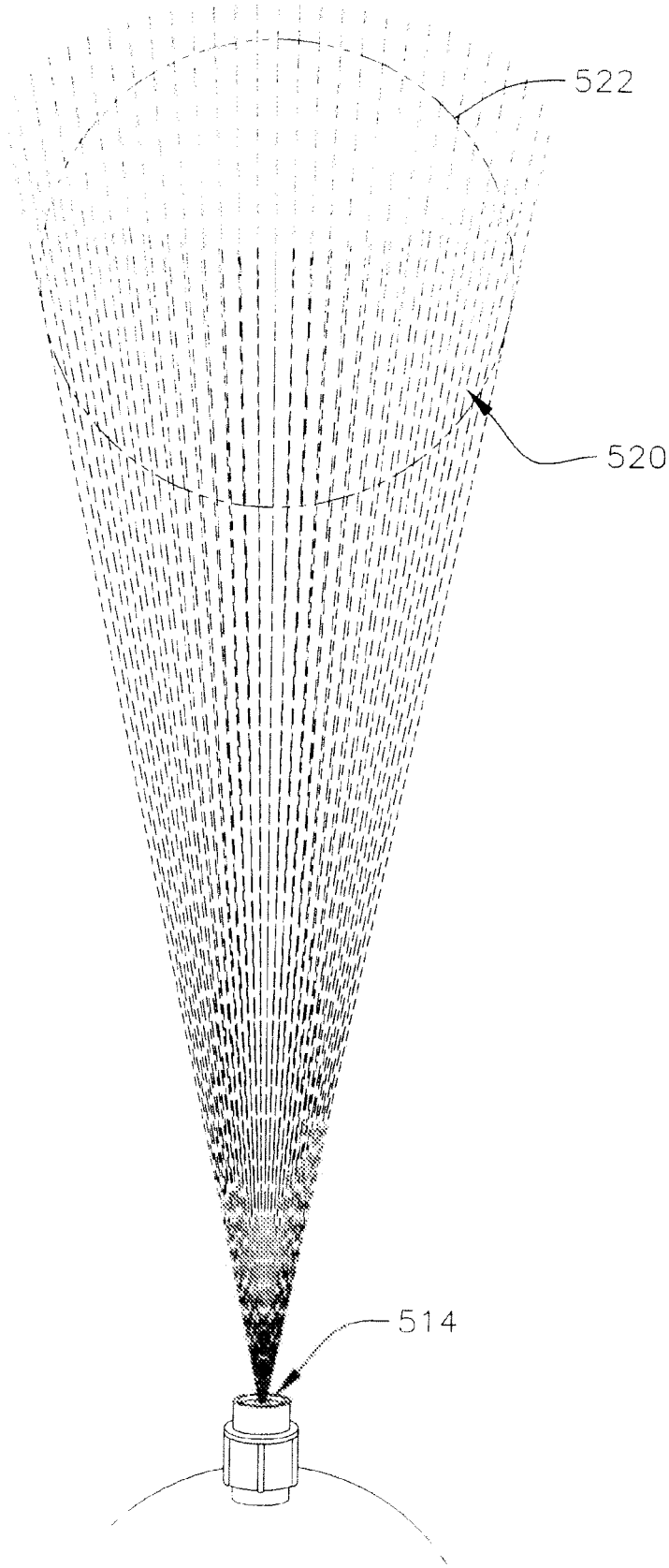
FIG. 5 is a view of the nozzle, spray, and ball of a water sprinkler toy according to embodiments of the present invention.

When a water source is attached to the inlet of the water sprinkler toy of the present invention, water travels through the base and out the nozzle. As shown in FIG. 5, the nozzle 514 creates a funnel shaped spray pattern 520. A ball 522 may then be placed inside the funnel shaped spray pattern 520. The ball then will levitate and/or spin around inside the funnel shaped spray pattern. Children will enjoy the cool spray of the water from the funnel shaped spray pattern itself, as it drifts, and will also enjoy the cool spray of water as the ball spins and flicks water around.

When the water sprinkler toy has an inflatable base and an inflatable beach ball, some setup may be required. For instance, the base and beach ball should be inflated. Accordingly, each will have a method of inflation, such as an inflation tube mouthpiece, traditionally used for inflation of objects. However, other methods of inflation could be used. Additionally, in some embodiments, the inflatable base has a reservoir. The reservoir could be adapted to contain a weight, such as sand or water. Therefore, prior to connecting a garden hose to the inlet, the hose could be used to fill the reservoir, and then the reservoir could be sealed. The garden hose could then be connected to the base, and turned on, creating a funnel shaped spray pattern. A ball can then be placed inside the funnel, where it levitates and/or spins around.

While the present invention has been illustrated and described with reference to certain exemplary embodiments, those of ordinary skill in the art would appreciate that various modifications and changes can be made to the described embodiments without departing from the spirit and scope of the present invention, as defined in the following claims.

What is claimed is:

1. A water sprinkler toy comprising:

a base having a water inlet and a substantially upwardly directed nozzle, the nozzle being configured to create a hollow funnel shaped column of water; a water supply connected to the water inlet; and a ball suspended within the hollow funnel shaped column of water.

2. The water sprinkler toy of claim 1, wherein the nozzle is an adjustable nozzle which can be adjusted to vary a diameter of the hollow funnel shaped column of water.

3. The water sprinkler toy of claim 1, wherein the nozzle is replaceable with nozzles adapted to spray water in hollow funnel shaped columns with varying diameters.

4. The water sprinkler toy of claim 1, wherein the hollow funnel shaped column of water has a cone shape or a pyramidal shape.

5. The water sprinkler toy of claim 1, wherein the hollow funnel shaped column of water is characterized by turbulent flow.

6. The water sprinkler toy of claim 1, wherein the base is an inflatable base and further comprises a stability reservoir.

7. The water sprinkler toy of claim 6, wherein the stability reservoir is adapted to contain water.

8. The water sprinkler toy of claim 6, wherein the inflatable base is in the shape of an animal selected from the group consisting of a seal, a whale, and an elephant.

9. The water sprinkler toy of claim 1, wherein the ball is unequally weighted.

10. The water sprinkler toy of claim 1, wherein the ball is a beach ball.

11. A water play toy comprising:

an upwardly directed nozzle;

a water supply connected to the upwardly directed nozzle for generating an outwardly tapering hollow spray of water; and a ball supported whithin the outwardly tapering hollow spray of water when water under pressure is supplied to the upwardly directed nozzle.

12. The water play toy of claim 11, wherein the outwardly tapering hollow spray of water is a cone like column of water and the upwardly directed nozzle is an adjustable upwardly directed nozzle that can be adjusted to vary a diameter of the cone like column of water.

13. The water play toy of claim 11, wherein the outwardly tapering hollow spray of water is a cone like column of water and the upwardly directed nozzle is replaceable with upwardly directed nozzles adapted to generate cone like columns of water with varying diameters.

14. The water play toy of claim 11, further comprising an inflatable base having a stability reservoir.

15. The water play toy of claim 14, wherein the inflatable base is in the shape of an animal selected from the group consisting of a seal, a whale, and an elephant.

16. The water play toy of claim 14, wherein the stability reservoir is adapted to contain water.

* * * * *

UNITED STATES PATENT AND TRADEMARK OFFICE

CERTIFICATE OF CORRECTION

PATENT NO. : 8,100,343 B2
APPLICATION NO. : 12/428319
DATED : January 24, 2012
INVENTOR(S) : Jeff A. Michelsen It is certified that error appears in the above-identified patent and that said Letters Patent is hereby corrected as shown below:

In the Claims

Column 6, Claim 11, line 13. Delete "whithin"

Insert -- within --

Signed and Sealed this
Twenty-sixth Day of June, 2012

David J. Kappos

David J. Kappos
*Director of the United States Patent and Trademark Office*